US011117042B2

(12) United States Patent
Kloster et al.

(10) Patent No.: US 11,117,042 B2
(45) Date of Patent: Sep. 14, 2021

(54) SPLITBOARD BINDING

(71) Applicants: Bryce M. Kloster, Issaquah, WA (US); Tyler G. Kloster, North Bend, WA (US)

(72) Inventors: Bryce M. Kloster, Issaquah, WA (US); Tyler G. Kloster, North Bend, WA (US)

( * ) Notice: Subject to any disclaimer, the term of this patent is extended or adjusted under 35 U.S.C. 154(b) by 0 days.

(21) Appl. No.: 16/865,147

(22) Filed: May 1, 2020

(65) Prior Publication Data

US 2020/0346097 A1 Nov. 5, 2020

Related U.S. Application Data

(60) Provisional application No. 62/842,907, filed on May 3, 2019.

(51) Int. Cl.

| | |
|---|---|
| ***A63C 10/14*** | (2012.01) |
| ***A63C 5/02*** | (2006.01) |
| ***A63C 10/02*** | (2012.01) |

(52) U.S. Cl.

CPC ..... *A63C 10/14* (2013.01); *A63C 5/02* (2013.01); *A63C 10/02* (2013.01)

(58) Field of Classification Search

CPC ..... A63C 10/14; A63C 5/02; A63C 10/02
See application file for complete search history.

(56) References Cited

U.S. PATENT DOCUMENTS

| | | | |
|---|---|---|---|
| 31,259 | A | 1/1861 | Rich |
| 1,473,011 | A | 11/1923 | Christophel |
| 1,477,692 | A | 12/1923 | Christophel |
| 2,660,812 | A | 12/1953 | Henke |
| 3,061,325 | A | 10/1962 | Glass |
| 3,171,667 | A | 3/1965 | Wightman |
| 3,439,928 | A | 4/1969 | Noguchi |

(Continued)

FOREIGN PATENT DOCUMENTS

| | | |
|---|---|---|
| CH | 681 509 A5 | 4/1993 |
| DE | 89 03154.7 | 3/1989 |

(Continued)

OTHER PUBLICATIONS

Brochure for Nitro USA Snowboards, dated 1993-1994.

(Continued)

*Primary Examiner* — Brian L Swenson
(74) *Attorney, Agent, or Firm* — Knobbe, Martens, Olson & Bear, LLP

(57) ABSTRACT

The present disclosure relates to splitboard bindings. The splitboard bindings can be used to change a splitboard between a snowboard for riding downhill in a ride mode and touring skis for climbing up a hill in a tour mode. The bindings can have a first interface and a second interface configured to engage and disengage. The interfaces can be configured such that a binding has large clearances for easy transitions. The first interface can be configured with a locking mechanism. The second interface can be configured to remove large clearances between the first interface and second interface, when the locking mechanism of the first interface is engaged with the second interface, allowing the first interface to attach tightly to the second interface and splitboard to improve the ride of the splitboard.

18 Claims, 12 Drawing Sheets

(56) References Cited

U.S. PATENT DOCUMENTS 3,506,279 A 4/1970 Lambert
3,593,356 A 7/1971 Schmalfeldt
3,627,349 A 12/1971 Barry
3,677,566 A 7/1972 Lawrence
3,782,745 A 1/1974 Stoveken
3,861,698 A 1/1975 Greig
4,022,491 A 5/1977 Powell
4,062,553 A 12/1977 Riedel
4,085,528 A 4/1978 Delery
4,138,128 A 2/1979 Criss
4,163,565 A 8/1979 Weber
4,190,970 A 3/1980 Annovi
4,221,394 A 9/1980 Campbell
4,275,904 A 6/1981 Pedersen
4,403,785 A 9/1983 Hottel
4,428,608 A 1/1984 Cooke et al.
4,473,235 A 9/1984 Burt
4,547,981 A 10/1985 Thais et al.
4,652,007 A 3/1987 Dennis
4,700,967 A 10/1987 Meatto et al.
4,705,308 A 11/1987 Bisbing
4,728,116 A 3/1988 Hill
4,741,550 A 5/1988 Dennis
4,770,441 A 9/1988 Demonsant et al.
4,817,988 A 4/1989 Chauvet et al.
4,856,808 A 8/1989 Longoni
4,871,337 A 10/1989 Harris
4,949,479 A 8/1990 Ottieri
4,951,960 A 8/1990 Sadler
4,955,632 A 9/1990 Giarritta et al.
4,973,073 A 11/1990 Raines et al.
4,979,760 A 12/1990 Derrah
4,982,733 A 1/1991 Broadhurst et al.
5,028,068 A 7/1991 Donovan
5,035,443 A 7/1991 Kincheloe
5,044,654 A 9/1991 Meyer
5,065,530 A 11/1991 Pozzobon et al.
5,065,533 A 11/1991 Paris
5,069,463 A 12/1991 Baud et al.
5,109,616 A 5/1992 Lush
5,145,202 A 9/1992 Miller
5,156,644 A 10/1992 Koehler et al.
5,249,816 A 10/1993 Southworth
5,299,823 A 4/1994 Glaser
5,344,179 A 9/1994 Fritschi et al.
5,397,150 A 3/1995 Commier et al.
5,462,318 A 10/1995 Cooke
5,499,461 A 3/1996 Danezin et al.
5,542,197 A 8/1996 Vincent
5,551,728 A 9/1996 Barthel et al.
5,553,883 A 9/1996 Erb
5,558,354 A 9/1996 Lion
5,570,522 A 11/1996 Olson et al.
5,618,051 A 4/1997 Kobylenski et al.
5,649,722 A 7/1997 Champlin
5,660,416 A 8/1997 Schiele et al.
5,697,631 A 12/1997 Ratzek et al.
5,701,689 A 12/1997 Hansen et al.
5,713,587 A 2/1998 Morrow et al.
5,741,023 A 4/1998 Schiele et al.
5,762,358 A 6/1998 Hale
5,765,853 A 6/1998 Erb
5,771,609 A 6/1998 Messmer
5,815,952 A 10/1998 Bobrowicz
5,816,590 A 10/1998 Fey et al.
5,820,139 A 10/1998 Grindl
5,884,933 A 3/1999 Trott
5,887,886 A 3/1999 Bourdeau
5,894,684 A 4/1999 Sand et al.
5,901,469 A 5/1999 Saillet
5,906,388 A 5/1999 Neiley
5,909,886 A 6/1999 Tugutaka et al.
5,937,546 A 8/1999 Messmer
5,941,552 A 8/1999 Beran
5,947,487 A 9/1999 Keleny et al.
5,966,843 A 10/1999 Sand et al.
5,966,844 A 10/1999 Hellerman et al.
5,979,082 A 11/1999 Pallatin
5,984,324 A 11/1999 Wariakois
5,984,325 A 11/1999 Acuna
6,000,711 A 12/1999 Fey et al.
6,015,161 A 1/2000 Carlson
6,041,721 A 3/2000 Weston
6,082,026 A 7/2000 Sand et al.
6,089,592 A 7/2000 Negus
6,105,992 A 8/2000 Schaller et al.
6,116,634 A 9/2000 Mometti
6,126,625 A 10/2000 Lundberg
6,138,384 A 10/2000 Messmer
6,206,402 B1 3/2001 Tanaka
6,231,057 B1 5/2001 Reuss et al.
6,272,772 B1 8/2001 Sherman
6,276,708 B1 8/2001 Hogstedt
6,390,492 B1 5/2002 Bumgarner et al.
6,464,237 B1 10/2002 Gracie
6,505,841 B1 1/2003 Kessler et al.
6,523,851 B1 2/2003 Maravetz
6,554,295 B2 4/2003 Rittmeyer
6,578,865 B1 6/2003 Chaput
6,609,720 B2 8/2003 Marmonier
6,616,151 B1 9/2003 Golling
6,648,365 B1 11/2003 Laughlin et al.
6,705,633 B2 3/2004 Poscich
6,729,642 B2 5/2004 Gouzes et al.
6,733,030 B2 5/2004 Okajima et al.
6,786,502 B2 9/2004 Carlson
6,792,702 B2 9/2004 Borsoi et al.
6,863,285 B2 3/2005 Gonthier
6,969,075 B2 11/2005 Dean et al.
7,029,023 B2 4/2006 Fourgere
7,073,813 B2 7/2006 Martin et al.
7,097,194 B2 8/2006 Kogler
7,147,233 B2 12/2006 Edmond
7,204,495 B2 4/2007 Reuss et al.
7,207,592 B2 4/2007 Pascal et al.
7,232,147 B2 6/2007 Courderc
7,246,811 B2 7/2007 Martin et al.
7,267,357 B2 9/2007 Miller et al.
7,306,241 B2 12/2007 Cunningham et al.
7,320,474 B2 1/2008 Quellais et al.
7,367,579 B2 5/2008 Elkington
7,427,079 B2 9/2008 Piva
7,503,579 B2 3/2009 Courderc
7,516,976 B2 4/2009 Cunningham et al.
7,568,719 B2 8/2009 Sauter
7,621,542 B2 11/2009 Warburton et al.
7,628,419 B2 12/2009 Gogarty
7,669,880 B2 3/2010 Doyle et al.
7,681,904 B2 3/2010 Ekberg
7,694,994 B2 4/2010 Lang et al.
7,823,905 B2 11/2010 Ritter
7,832,754 B2 11/2010 Girard et al.
7,931,292 B2 4/2011 Miralles
7,992,888 B2 8/2011 Steere
8,033,564 B2 10/2011 Riepler et al.
8,132,818 B2 3/2012 Cunningham et al.
8,167,321 B2 5/2012 Cunningham et al.
8,226,109 B2 7/2012 Ritter
8,348,299 B2 1/2013 Ekberg
8,371,605 B2 2/2013 Neiley et al.
8,469,372 B2 6/2013 Kloster et al.
8,480,546 B2 7/2013 Spencer
8,662,505 B2 3/2014 Cunningham et al.
8,684,394 B2 4/2014 Smith
8,708,371 B2 4/2014 Balun
8,720,910 B2 5/2014 Caslowitz
8,733,783 B2 5/2014 Kloster et al.
8,764,043 B2 7/2014 Neubauer et al.
8,857,845 B2 10/2014 Ohlheiser
9,132,336 B2 9/2015 Bulan
9,138,628 B2 9/2015 Kloster et al.
9,220,968 B2 12/2015 Ritter
9,227,131 B2 1/2016 Adamczewski et al.
9,238,168 B2 1/2016 Kloster et al.

(56) References Cited

U.S. PATENT DOCUMENTS

| | | | | |
|---|---|---|---|---|
| 9,266,010 | B2 | 2/2016 | Kloster et al. | |
| 9,452,344 | B2 | 9/2016 | Ritter | |
| 9,604,122 | B2 | 3/2017 | Kloster et al. | |
| 9,795,861 | B1 | 10/2017 | Kloster et al. | |
| 9,821,214 | B2 | 11/2017 | Browning | |
| 9,937,407 | B2 | 4/2018 | Kloster et al. | |
| 10,029,165 | B2 | 7/2018 | Kloster et al. | |
| 2002/0062581 | A1 | 5/2002 | Courderc | |
| 2003/0075885 | A1 | 4/2003 | Laughlin | |
| 2004/0061311 | A1 | 4/2004 | De Bortoli et al. | |
| 2004/0169343 | A1 | 9/2004 | Fougere | |
| 2005/0057009 | A1 | 3/2005 | Courderc | |
| 2005/0161911 | A1 | 7/2005 | Piva | |
| 2005/0177083 | A1 | 8/2005 | Heil | |
| 2005/0253347 | A1 | 11/2005 | Martin et al. | |
| 2006/0175802 | A1 | 8/2006 | Maravetz et al. | |
| 2006/0237920 | A1 | 10/2006 | Steere | |
| 2007/0063459 | A1 | 3/2007 | Kavarsky | |
| 2007/0170697 | A1 | 7/2007 | Courderc | |
| 2007/0216137 | A1 | 9/2007 | Ritter | |
| 2008/0116664 | A1 | 5/2008 | Warburton | |
| 2008/0185814 | A1 | 8/2008 | Riepler et al. | |
| 2009/0146396 | A1 | 6/2009 | Hahnenberger | |
| 2009/0146397 | A1 | 6/2009 | Steere | |
| 2009/0250906 | A1 | 10/2009 | Ritter | |
| 2010/0102522 | A1* | 4/2010 | Kloster | A63C 10/28 280/14.24 |
| 2010/0304937 | A1 | 12/2010 | Spencer | |
| 2011/0184326 | A1 | 7/2011 | Ingimundarson et al. | |
| 2011/0197362 | A1 | 8/2011 | Chella et al. | |
| 2011/0254251 | A1 | 10/2011 | Jung | |
| 2011/0285109 | A1 | 11/2011 | Horn | |
| 2012/0061927 | A1 | 3/2012 | Krenn | |
| 2012/0256395 | A1* | 10/2012 | Ritter | A63C 5/02 280/623 |
| 2012/0274036 | A1* | 11/2012 | Kloster | A63C 5/0411 280/11.31 |
| 2012/0292887 | A1 | 11/2012 | Ohlheiser | |
| 2013/0147159 | A1 | 6/2013 | Neiley et al. | |
| 2013/0193672 | A1 | 8/2013 | Bulan | |
| 2013/0214512 | A1 | 8/2013 | Kloster et al. | |
| 2013/0277947 | A1 | 10/2013 | Kloster et al. | |
| 2013/0341889 | A1 | 12/2013 | Neubauer | |
| 2014/0167392 | A1 | 6/2014 | Kloster et al. | |
| 2014/0210187 | A1 | 7/2014 | Ritter | |
| 2014/0232087 | A1 | 8/2014 | Bulan | |
| 2014/0291965 | A1 | 10/2014 | Kloster et al. | |
| 2015/0014962 | A1* | 1/2015 | Rayner | A63C 5/02 280/611 |
| 2015/0021881 | A1 | 1/2015 | Hutchison | |
| 2015/0048597 | A1 | 2/2015 | Tudor | |
| 2015/0157920 | A1 | 6/2015 | Adamczewski et al. | |
| 2015/0343297 | A1 | 12/2015 | Ekberg | |
| 2016/0136505 | A1 | 5/2016 | Kavarsky | |
| 2016/0175685 | A1 | 6/2016 | Kloster et al. | |
| 2016/0175690 | A1* | 6/2016 | Ritter | A63C 10/14 280/618 |
| 2016/0175691 | A1 | 6/2016 | Ritter | |
| 2016/0199722 | A1 | 7/2016 | Ritter | |
| 2016/0279505 | A2 | 9/2016 | Ritter | |
| 2016/0310824 | A1 | 10/2016 | Kloster et al. | |
| 2016/0310825 | A1 | 10/2016 | Kloster et al. | |
| 2017/0050105 | A1 | 2/2017 | Browning | |
| 2017/0189788 | A1 | 7/2017 | Wariakois | |
| 2017/0216710 | A1 | 8/2017 | Debney | |
| 2017/0282050 | A1 | 10/2017 | Kloster et al. | |
| 2018/0140930 | A1 | 5/2018 | Kloster et al. | |
| 2018/0140931 | A1 | 5/2018 | Kloster et al. | |

FOREIGN PATENT DOCUMENTS

| | | |
|---|---|---|
| DE | 91 08 618.3 | 1/1992 |
| DE | 296 18 514 U1 | 10/1996 |
| EP | 0 362 782 A2 | 4/1990 |
| EP | 0 680 775 B1 | 11/1995 |
| WO | WO 1998/017355 | 4/1998 |

OTHER PUBLICATIONS

U.S. Appl. No. 12/604,256, filed Oct. 22, 2009, including its prosecution history.
Web page showing Salomon SNS Pilot Combi binding, www.salomon.com/us/products/sns-pilot-combi.html, dated Mar. 20, 2012.
U.S. Appl. No. 13/458,560, filed Apr. 27, 2012, including its prosecution history.
U.S. Appl. No. 13/763,453, filed Feb. 8, 2013, including its prosecution history.
U.S. Appl. No. 13/915,370, filed Jun. 11, 2013, including its prosecution history.
U.S. Appl. No. 13/925,546, filed Jun. 24, 2013, including its prosecution history.
U.S. Appl. No. 14/287,938, filed May 27, 2014, including its prosecution history.
U.S. Appl. No. 14/860,213, filed Sep. 21, 2015, including its prosecution history.
U.S. Appl. No. 15/050,064, filed Feb. 22, 2016, including its prosecution history.
U.S. Appl. No. 15/139,175, filed Apr. 26, 2016, including its prosecution history.
U.S. Appl. No. 15/470,142, filed Mar. 27, 2017, including its prosecution history.
U.S. Appl. No. 15/790,527, filed Oct. 23, 2017, including its prosecution history.
U.S. Appl. No. 15/790,927, filed Oct. 23, 2017, including its prosecution history.
U.S. Appl. No. 15/942,142, filed Mar. 30, 2018, including its prosecution history.
U.S. Appl. No. 16/171,055, filed Oct. 25, 2018, including its prosecution history.
U.S. Appl. No. 16/502,683 filed Jul. 3, 2019, including its prosecution history.
Purported excerpts of Nitro USA Snowboards Catalog, 1993-1994.
Purported brochure of Nitro USA Snowboards and Fritschi Tour Snowboard Binding.
Purported photographs of Nitro Board and Tour Lock System.

* cited by examiner

SPLITBOARD BINDING

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

The present disclosure generally relates to split snowboards, also known as splitboards, and includes the disclosure of embodiments of splitboard joining devices. Splitboards are used for accessing backcountry terrain. Splitboards have a "ride mode" and a "tour mode." In ride mode, the splitboard is configured with at least two skis held together to form a board similar to a snowboard with bindings mounted somewhat perpendicular to the edges of the splitboard. In ride mode, a user can ride the splitboard down a mountain or other decline, similar to a snowboard. In tour mode, the at least two skis of the splitboard are separated and configured with bindings that are typically mounted like a cross country free heel ski binding. In tour mode, a user normally attaches skins to create traction when climbing up a hill. In some instances, additional traction beyond what the skins provide is desirable and, for example, crampons are used. When a user reaches the top of the hill or desired location the user can change the splitboard from tour mode to ride mode and snowboard down the hill.

SUMMARY

Some embodiments provide a splitboard binding having a first interface configured to receive a boot. The first interface can have a first attachment portion and a second attachment portion such that the first attachment portion generally opposes the second attachment portion. The splitboard binding can have a second interface configured to attach to a splitboard. The second interface can be configured to couple to the first interface in a ride mode configuration. The second interface can have a first receiving component and a second receiving component such that the first receiving component is configured to be attached to a first splitboard ski and the second receiving component is configured to be attached to a second splitboard ski. The first attachment portion can be configured to engage the first receiving component and the second attachment portion can be configured to engage the second receiving component. The second attachment portion can have a locking mechanism with an open position and a locked position.

In some embodiments, the interfaces can have at least three configurations. For example, the first interface and the second interface can have a first configuration where the interfaces are disengaged. The first interface and the second interface can also have a second configuration where the interfaces are loosely engaged with a clearance fit in at least two directions and the locking mechanism of the first interface is in the open position. Additionally, the first interface and the second interface can have a third configuration where the interfaces are substantially fixed and join the splitboard skis. In the third configuration, the locking mechanism of the first interface can be in the locked position. When the locking mechanism of the first interface is in the locked position and engaged with the second interface, the locking mechanism can constrain the interfaces in at least two directions and the second interface can compress the first interface into the splitboard skis.

Some embodiments provide a splitboard binding have a first interface with a toe side, a heel side, a medial side and a lateral side. The first interface and the second interface can have a first configuration where the interfaces are disengaged. The first interface and the second interface can have a second configuration where the interfaces are loosely engaged with a loose clearance fit in a direction generally perpendicular to the medial and lateral sides of the first interface, at least the locking mechanism of the first interface is free from vertical constraint, and the locking mechanism of the first interface is in the open position. The first interface and the second interface can also have a third configuration where the interfaces are substantially fixed and join the splitboard skis to form a snowboard. In the third configuration, the locking mechanism of the first interface can be in the locked position. When the locking mechanism is in the locked position and engaged with the second interface, the locking mechanism can constrain the first interface to the second interface both vertically and in a direction generally perpendicular to the medial and lateral sides of the first interface.

In some embodiments, the first interface and the second interface can have a first configuration where the interfaces are disengaged and a second configuration where the first interface engages and disengages the second interface in a generally vertical direction. The first interface and the second interface can have a third configuration where the engagement of a locking mechanism of the first interface with the second interface constrains movement of the first interface relative to the second interface in a plane parallel to the top surface of the first splitboard ski and prevents disengagement of the first interface from the second interface in a generally vertical direction.

BRIEF DESCRIPTION OF THE DRAWINGS

These and other features, aspects, and advantages of the disclosed apparatus, systems, and methods will now be described in connection with embodiments shown in the accompanying drawings, which are schematic and not necessarily to scale. The illustrated embodiments are merely examples and are not intended to limit the apparatus, systems, and methods. The drawings include the following figures, which can be briefly described as follows.

DESCRIPTION

A splitboard is a snowboard that splits into at least two skis for climbing uphill in a touring configuration. When the splitboard is in the touring configuration, traction skins can be applied to the base of the snowboard to provide traction when climbing uphill. The splitboard bindings are attached to a tour mode interface on the skis allowing the user to use the skis like cross country skis to climb. When the user reaches a location where the user would like to snowboard down a hill, the user removes the traction skins and joins the at least two skis with a joining device to create a snowboard and attaches the splitboard bindings to the ride mode interfaces. An integral part of achieving optimal performance, such that the splitboard performs like a solid snowboard, is the connection between the splitboard bindings and the ride mode interfaces. It is critical that the transition between the tour mode configuration and the ride mode configuration is smooth and can be easily performed in a variety of snow conditions. Clearances between the splitboard binding and the ride mode are critical for snow packing and icing to not affect the ease of transition. A challenge with existing art is that having large clearances between the splitboard binding and ride mode make for a sloppy connection and having tighter clearances makes for a more challenging transition in snowy or icy conditions.

There is a need for a splitboard binding that can have large clearances for easy transitions and attaches tightly to the ride mode and splitboard to improve the ride of the splitboard.

Figure 1A:
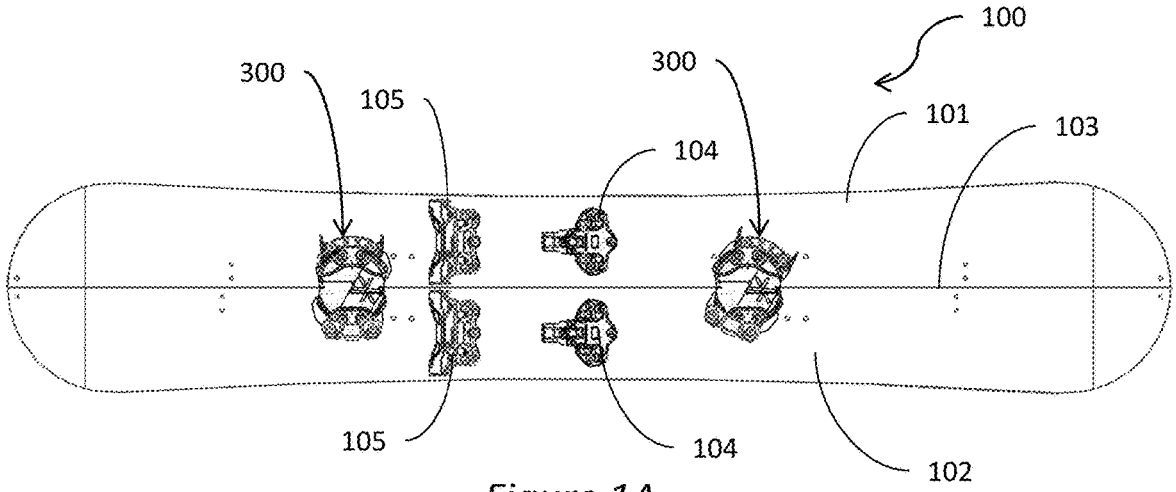
FIG. 1A is a top view of a splitboard with ride mode interfaces and tour mode interfaces in the ride mode configuration.
Figure 1B:
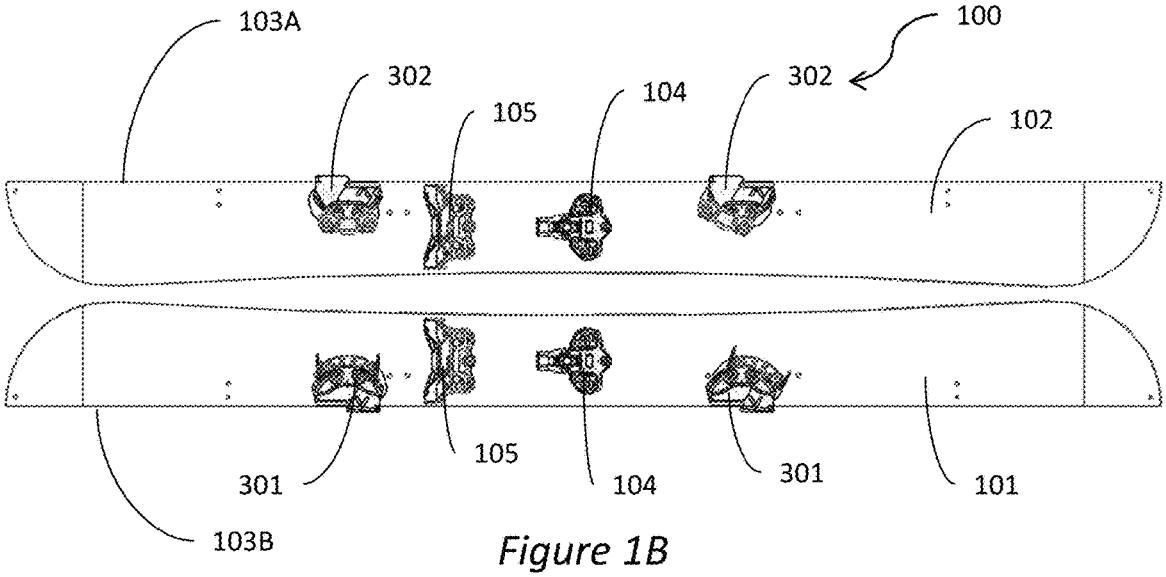
FIG. 1B is a top view of a splitboard with ride mode interfaces and tour mode interfaces in the tour mode configuration.
Figure 1C:
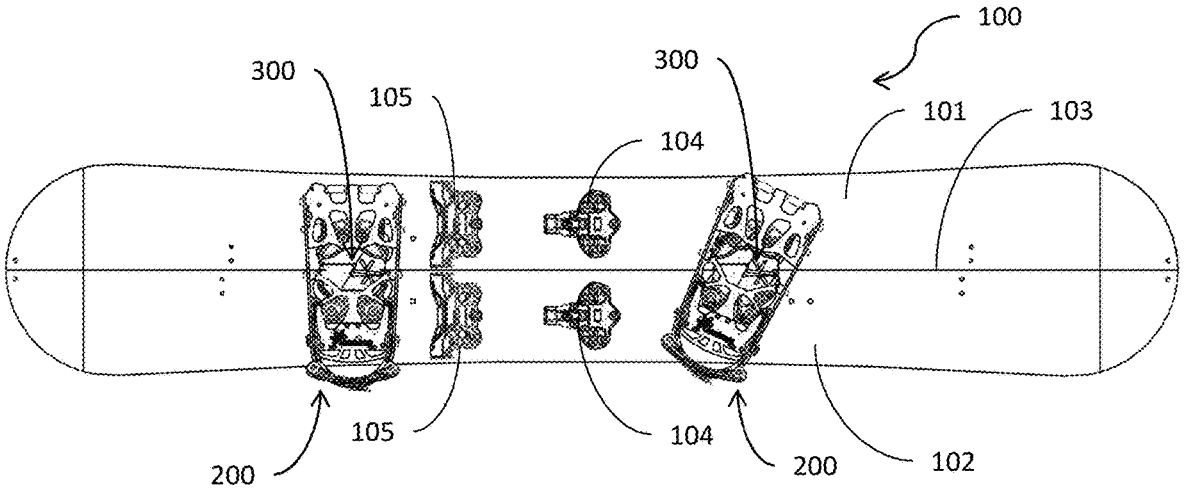
FIG. 1C is a top view of a splitboard, in the ride mode configuration, with ride mode interfaces, tour mode interfaces, and splitboard bindings attached to the ride mode.
Figure 1D:
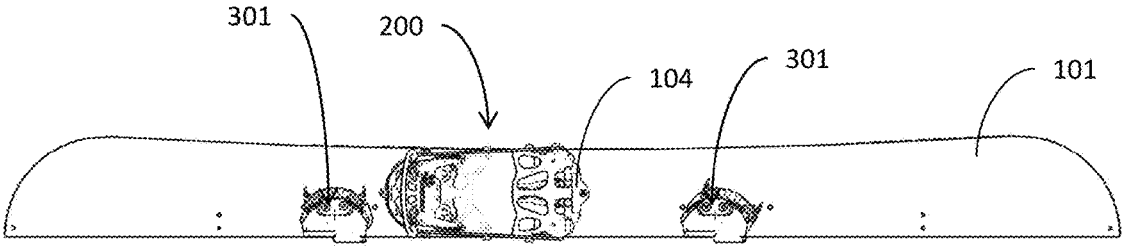
FIG. 1D is a top view of one ski of a splitboard, in the tour configuration, with the splitboard binding attached to the tour mode interface.

With reference to the drawings, FIGS. 1A through 1D show a splitboard 100. FIG. 1A shows a top view of splitboard 100 in the ride mode configuration with ski 101 and 102 together to form a snowboard for riding down a slope. The center of the snowboard where ski 101 and 102 touch is seam 103. Splitboard 100 can have a ride mode interface 300, a tour mode interface 104, and risers 105. There are two ride mode interfaces 300, tour mode interfaces 104 and risers 105; one for the left foot and the other for the right foot of a user. FIG. 1B shows a top view of the splitboard 100 in the tour mode configuration with ski 101 and ski 102 separated for touring up a hill. When separated seam 103 has inside edge 103A on ski 102 and inside edge 103B on ski 101. Ride mode 300 has a heel side component 302 that can attach to ski 102 and a toe side component 301 that can attach to ski 101. The heel side component 302 could also be attached to ski 101 and the toe side component 301 could be attached to ski 102 as well. The ski to which heel side component 302 and toe side component 301 are attached to is determined by which foot the user chooses to be their front foot, left or right. The ride mode interface 300 works the same regardless of which foot the user chooses as their front foot. FIG. 1C shows at top view of splitboard 100 with example binding interface 200 attached to ride mode interface 300. Binding interface 200 is firmly attached to ride mode 300. FIG. 1D shows a top view of ski 101 with binding interface 200 attached to tour mode interface 104.

Figure 2A:
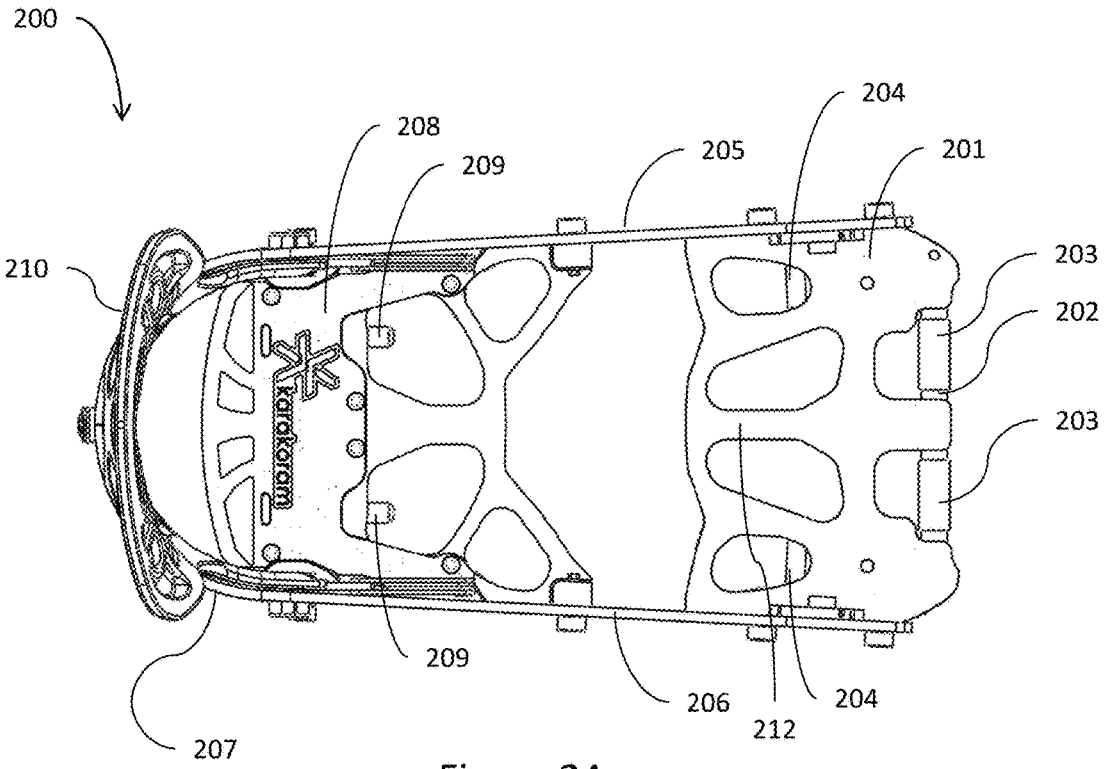
FIG. 2A is a top view of an example splitboard binding with the locking mechanism in the locked position.

FIG. 2A is a top view of an example binding interface 200. Binding interface 200 is configured to receive a snowboard boot. Binding interface 200 is shown without toe straps and ankle straps for ease of viewing. Toe straps hold the toe of a user's boot in the splitboard board binding. Ankle straps hold the ankle of a user's boot in the splitboard binding. Not all splitboard bindings use straps. Splitboard bindings can use wire bales to hold a boot to the splitboard binding as well. Binding interface 200 can have a base with a toe side portion and a heel side portion. The toe side portion can comprise a toe stay 201. The heel side portion can comprise a heel stay 208. Toe stay 201 and heel stay 208 can be separate components as shown in FIG. 2A or they can be opposing sides of the same component. Toe stay 201 and heel stay 208 can be machined from metal, formed from metal, molded from plastic, molded from fiber reinforced plastic or made by many other manufacturing processes. Heel stay 208 can be made from multiple components. Toe stay 201 can be made from multiple components. Binding interface 200 can further comprise a heelcup 207 with a left side 205 and a right side 206. Left side 205 can be the medial or lateral side of the binding depending on which foot the binding is used for. Right side 206 can be the medial or lateral side of the binding depending on which foot the binding is used for. For ease of understanding, we will assume the binding described in this description herein will be for the right foot of a user when we refer to the medial and lateral directions. Heel stay 208 can have locking pin 209 as shown in FIG. 2A. Locking pin 209 can slide in and out of heel stay 208. Toe stay 201 can have catch pins 204 as shown in FIG. 2A. Lock pins 209 oppose catch pins 204. In some embodiments, locking pins 209 can also be a part of the toe stay 201 and the catch pins 204 can be a part of heel stay 208. In some embodiments, catch pins 204 can be any element or mating surface to engage the ride mode 300. Toe stay 201 can have tour pivot pin 202 with sleeves 203 for attaching to tour mode 104. Binding interface 200 can have a highback 210. In some embodiments, locking pins 209 can be replaced with a multitude of similar locking elements such as a cam, an eccentric lobe, a wedge, a keyed pin, or any element that can move to complete engagement and complete disengagement of the ride mode 300.

Figure 2B:
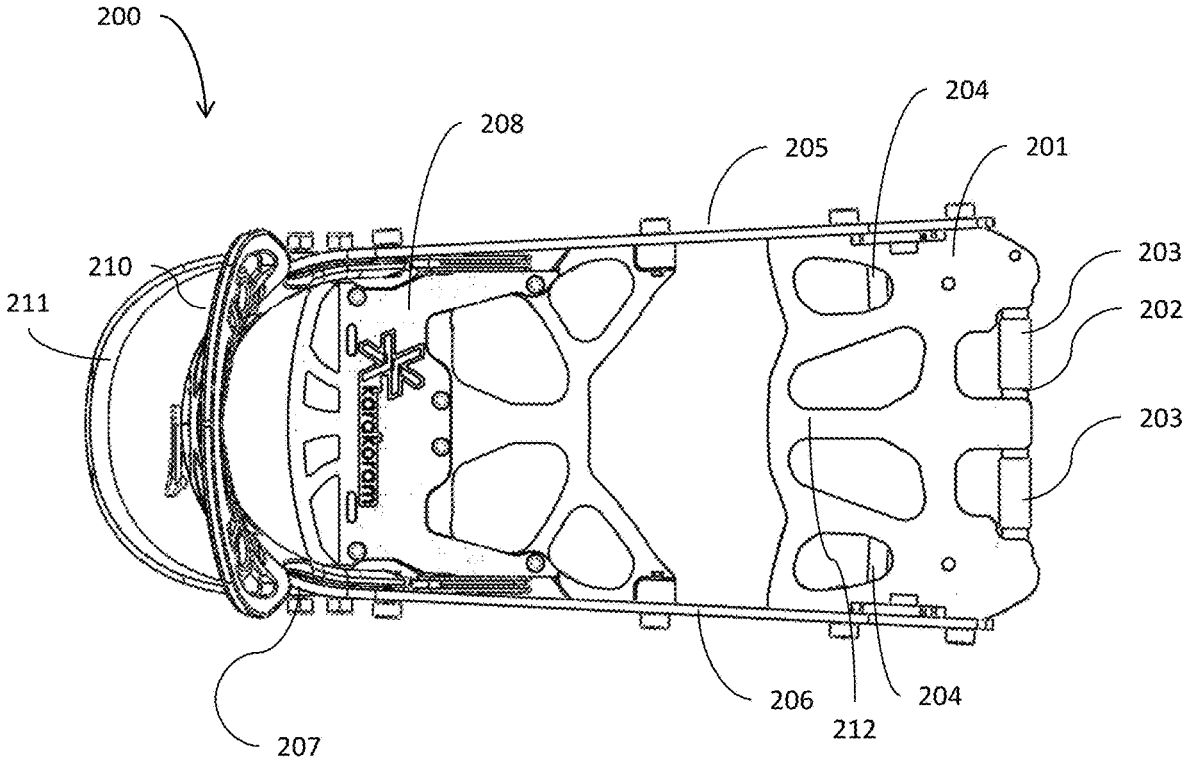
FIG. 2B is a top view of an example splitboard binding with the locking mechanism in the open position.

FIG. 2B shows a top view of example binding interface 200 which can have lever 211 to drive lock pin 209. In FIG. 2B, lever 211 is opened causing lock pins 209 to retract into heel stay 208.

Figure 2C:
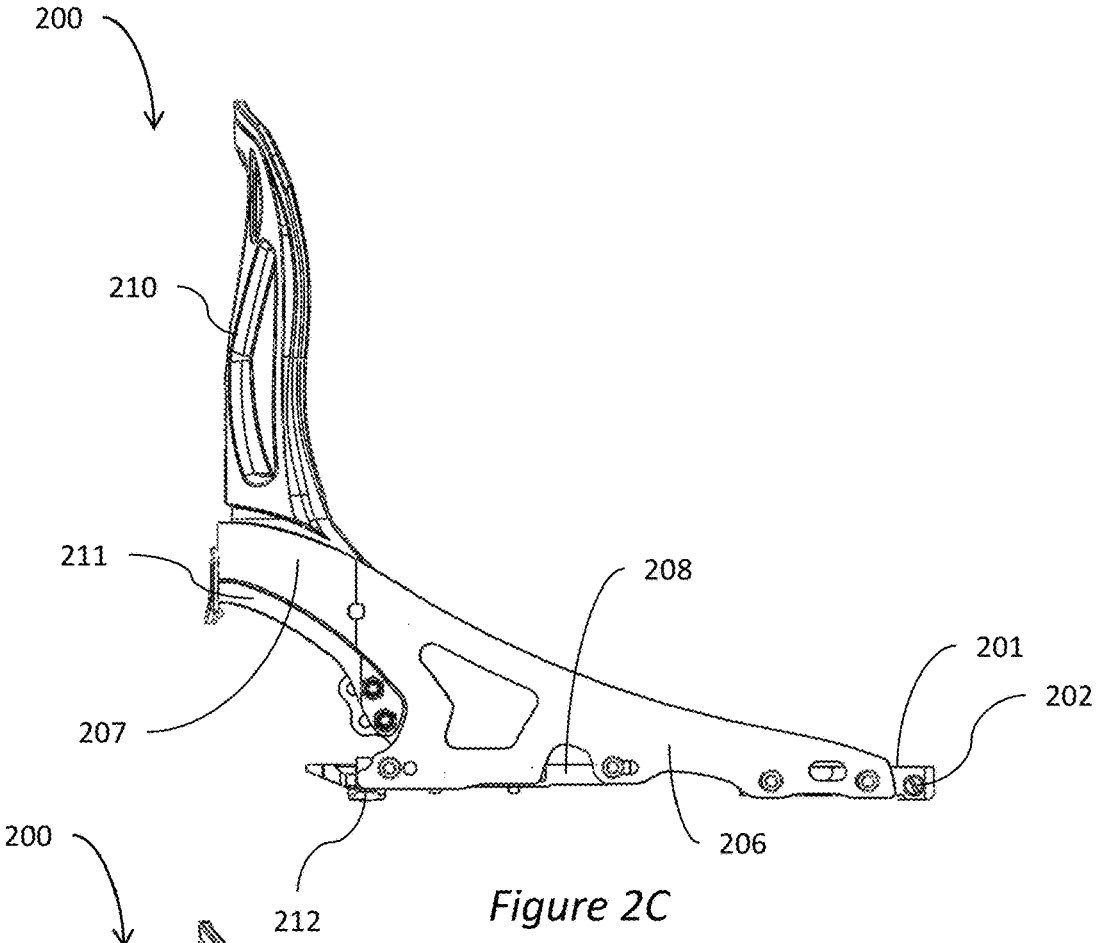
FIG. 2C is a side view of an example splitboard binding with the locking mechanism in the locked position.

FIG. 2C shows a side view of example binding interface 200 with lever 211 in the closed position and lock pin 209 extending out of heel stay 208.

Figure 2D:
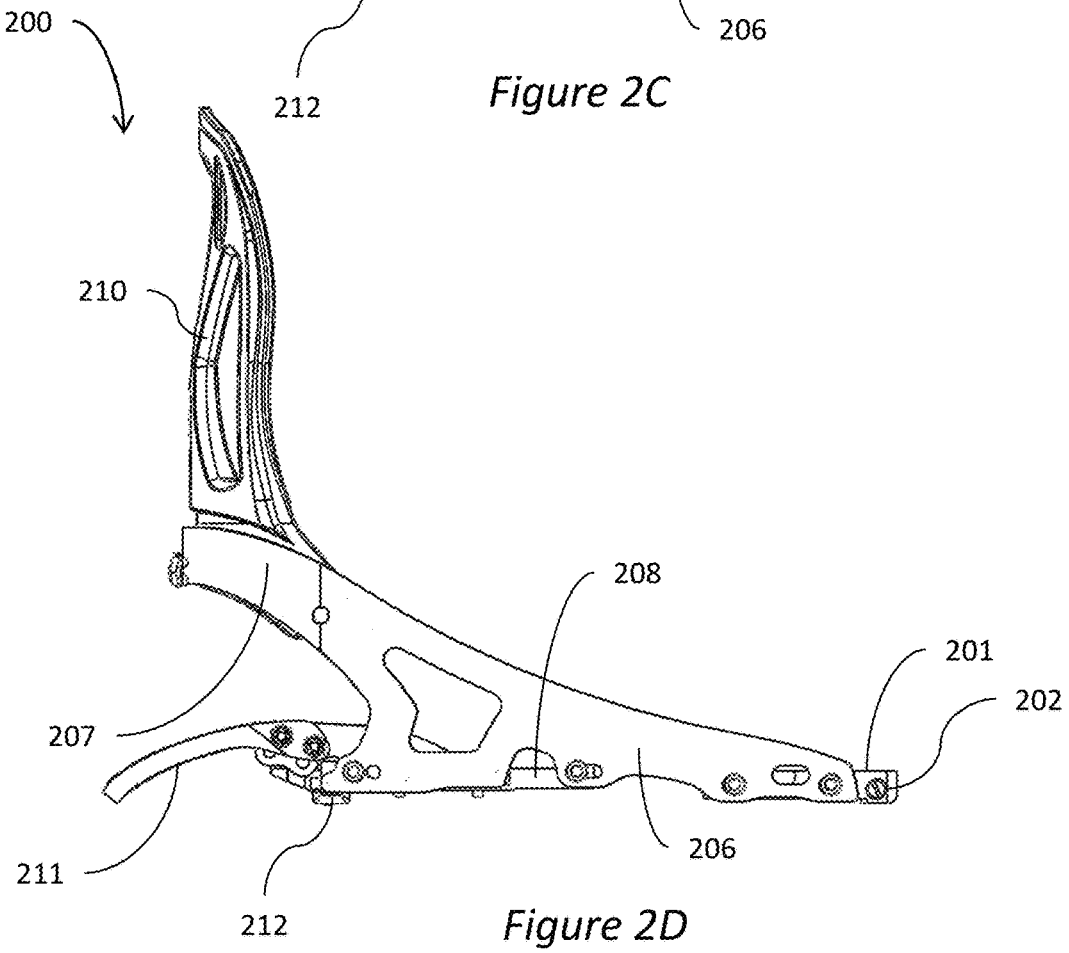
FIG. 2D is a side view of an example splitboard binding with the locking mechanism in the open position.

FIG. 2D shows a side view of example binding interface 200 with lever 211 in the open position and lock pin 209 retracted into heel stay 208.

Figure 2E:
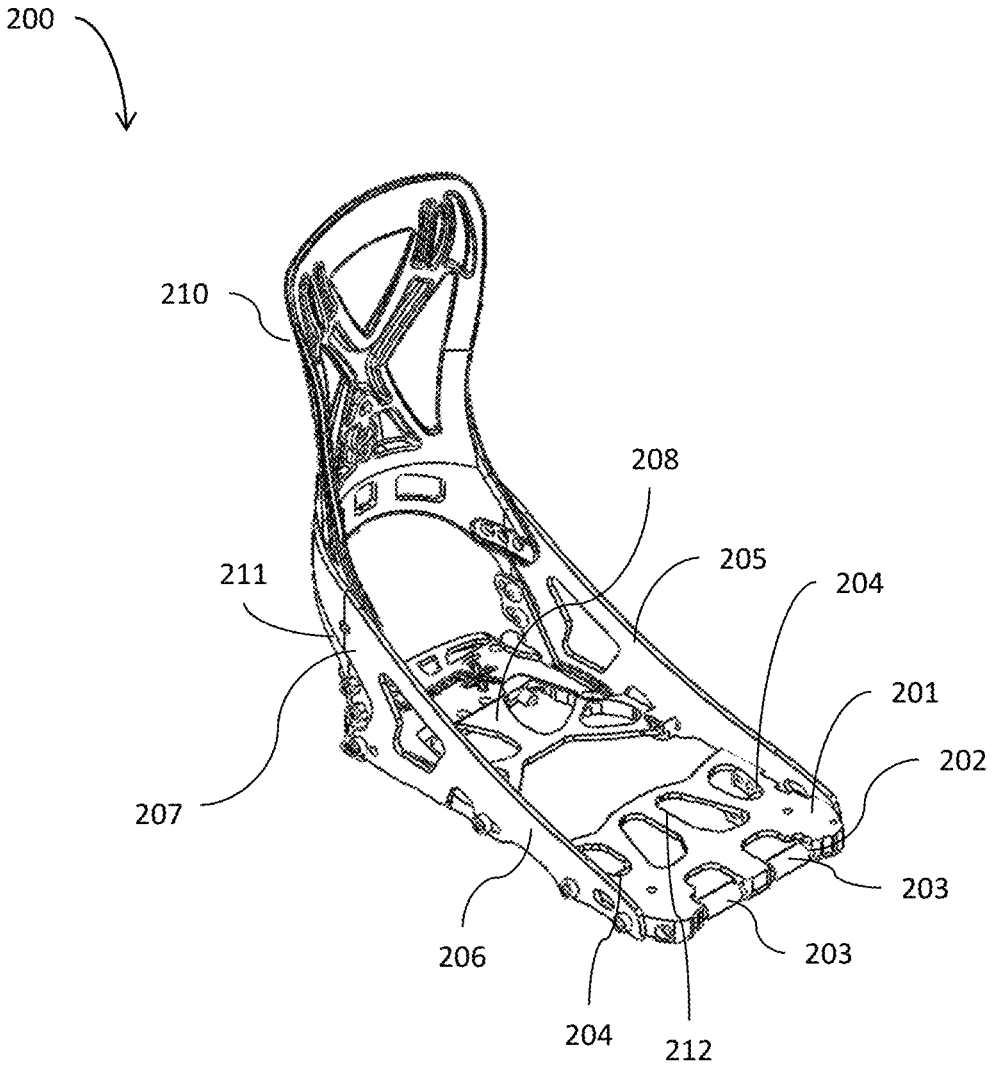
FIG. 2E is an isometric view of an example splitboard binding with the locking mechanism in the locked position.

FIG. 2E shows an isometric view of example binding interface 200 with lever 211 in the closed position and lock pin 209 extending out of heel stay 208.

Figure 3A:
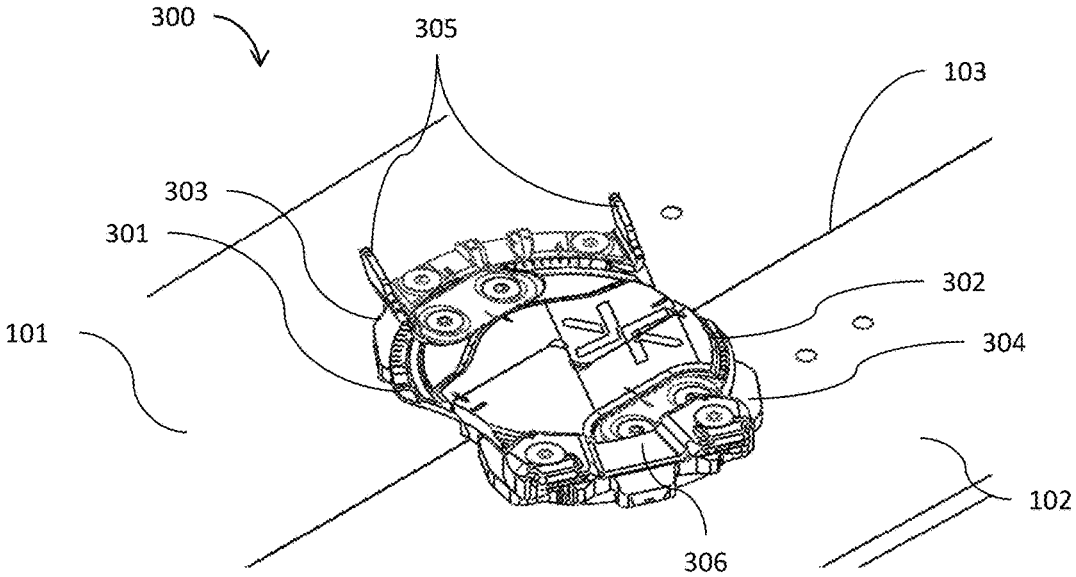
FIG. 3A is an isometric view of an example ride mode interface.
Figure 3B:
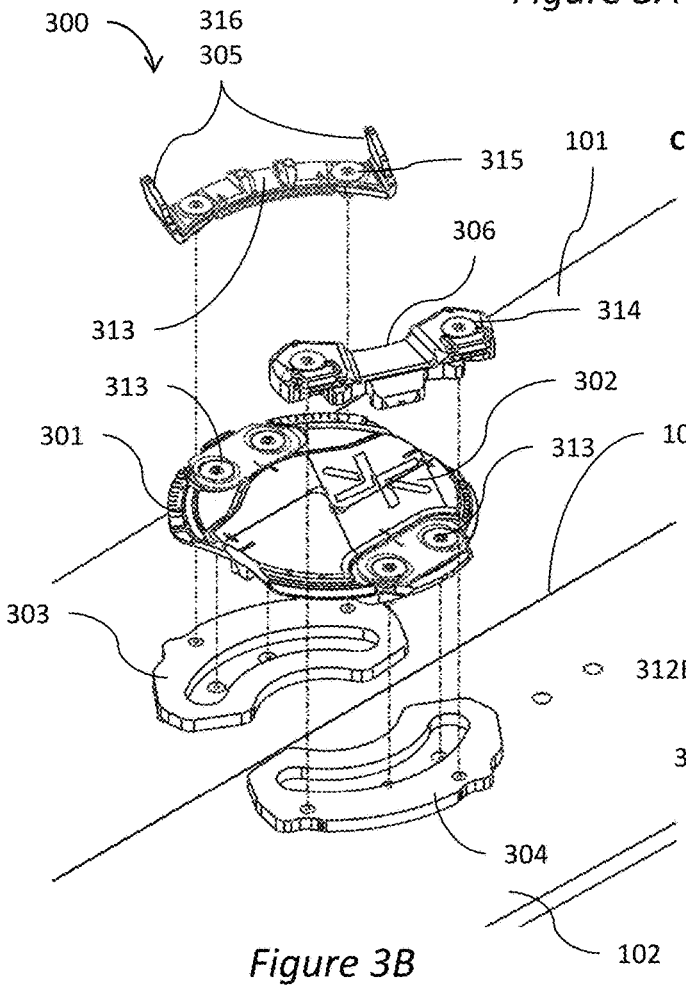
FIG. 3B is an exploded isometric view of an example ride mode interface.

FIGS. 3A through 3G show views of ride mode interface 300. FIG. 3A is an isometric view of ride mode 300. Ride mode 300 can comprise a heel side component 302, a toe side component 301, a toe side angle adjuster 303, a heel side angle adjuster 304, a toe attachment 316 and a heel attachment 306. FIG. 3B shows an exploded isometric view of ride mode 300. Heel side component 302 can be attached to ski 102 with mounting screws 313 clamping heel side angle adjuster 304 to ski 102. Heel attachment 306 can attach to heel side angle adjuster 304 with screws 314. Heel attachment 306 is configured to receive heel stay 208 of example binding interface 200. Toe side component 301 can be attached to ski 101 with mounting screws 313 clamping toe side angle adjuster 303 to ski 101. Toe attachment 316 can attach to toe side angle adjuster 303 with screws 315. Toe attachment 305 can have positioning element 313 and catches 305. Toe attachment 305 is configured to receive toe stay 201 of example binding interface 200.

Figure 3C:
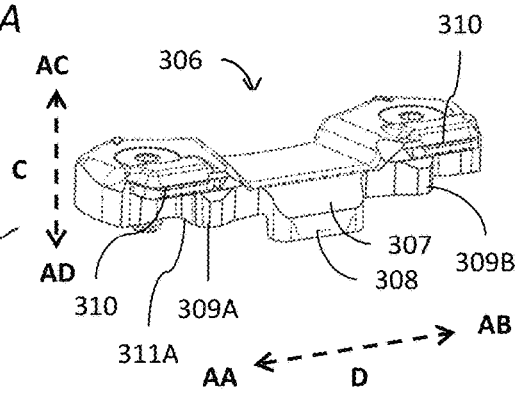
FIG. 3C is a detailed isometric view of the heel attachment of an example ride mode interface.

FIG. 3C is a detailed isometric view of heel attachment 306 of ride mode interface 300. Heel attachment 306 can comprise of vertical constraint element 310 which when engaged with lock pin 209 of example binding interface 200 constrains example binding interface 200 generally vertically along path C in direction AC. Heel attachment 306 can further comprise horizontal guide 309A, horizontal guide 309B, horizontal constraint element 311A, and horizontal constraint element 311B. Horizontal guides 309A and 309B are chamfered lead-ins to allow for easier alignment of example binding interface 200 to ride mode interface 300. As lock pins 209 engage horizontal guides 309A and 309B example binding interface 200 aligns properly along horizontal path D. Horizontal constraint element 311A constrains example binding interface 200 generally horizontally along path D in the medial direction AB. Horizontal constraint element 311B constrains example binding interface 200 generally horizontally along path D in the lateral direction AA. See FIGS. 6A through 6D for a detailed view on the interaction between lock pins 209 and heel attachment 306. Heel attachment 306 can further comprise a heel-to-toe constraint element 308 with lead-in 307. Heel stay 208 of example binding interface 200 can engage heel-to-toe constraint element to constrain along path E in a general heel to toe direction AF (see FIG. 3D). Lead-in 307 aids in making the engagement of example binding interface 200 and ride mode interface 300.

Figure 3D:
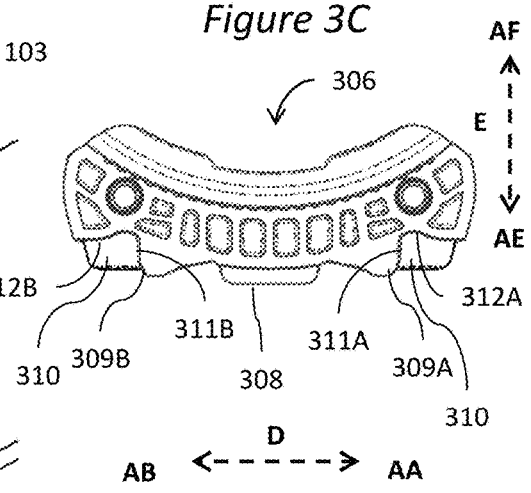
FIG. 3D is a detailed bottom view of the heel attachment of an example ride mode interface.

FIG. 3D is a bottom view of heel attachment 306. From the bottom view you can further see back stops 312A and 312B.

Figure 3E:
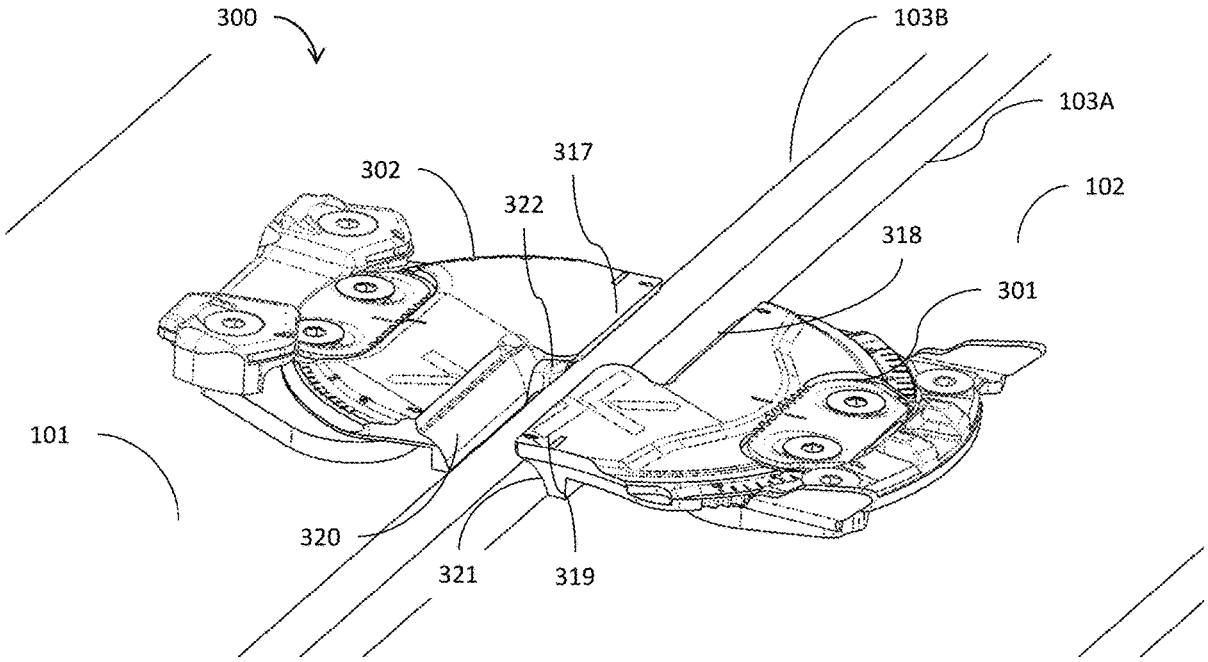
FIG. 3E is a perspective view of an example ride mode interface.
Figure 3F:
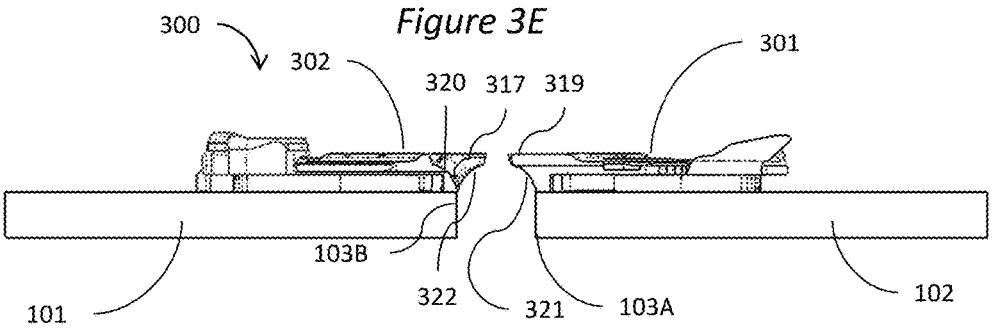
FIG. 3F is a front view of an example ride mode interface.
Figure 3G:
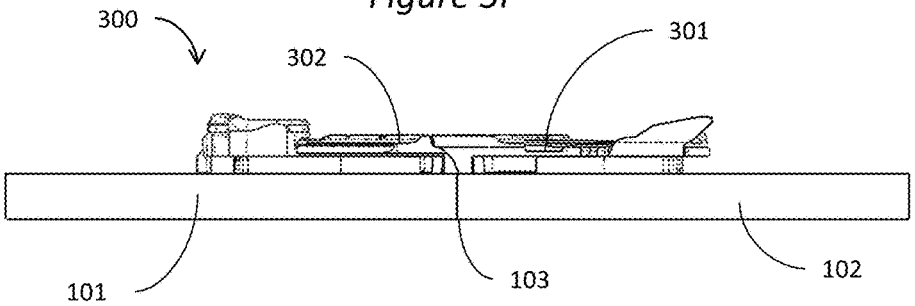
FIG. 3G is a front view of an example ride mode interface.

FIG. 3E is a perspective view of a ride mode interface 300. FIG. 3F is a front view of ride mode interface 300 with ski 101 and ski 102 separated. FIG. 3G is a front view of ride mode interface 300 with ski 101 and ski 102 joined to form a snowboard. Heel side component 302 of ride mode 300 can have a vertical movement restraint 317 that is positioned above the top surface of ski 101. Vertical movement restraint 317 can extend past inside edge 103B such that when ski 101 and ski 102 are joined as shown in FIG. 3G, vertical movement restraint 317 extends over ski 102 to prevent or limit upward movement of ski 102 relative to ski 101. Vertical movement restraint 317 can have surface 322 that extends in a generally radial shape from the top of heel side component 302 to the bottom of heel side component 302. The bottom of surface 322 is designed to be generally tangent to the inside edge 103B. The generally radial shape of surface 322 and tangency to inside edge 103B limit and/or prevent snow and ice buildup between inside edge 103B and heel side component 302. Toe side component 301 has a mating surface 318 to surface 322. Surface 318 can match the same generally radial shape of surface 322. When ski 101 and ski 102 are joined as shown in FIG. 3G, surface 318 and surface 322 can touch to prevent or limit upward movement of ski 102 relative to ski 101. Surface 322 can be replaced with a multitude of surface types such as a 45 degree surface or any other surface that prevents a sharp 90 degree angle between inside edge 103B and vertical movement restraint 317 where snow or ice can easily build up. Surface 322 can be designed to allow snow and/or ice to be removed easily with a user's fingers, with or without gloves. Toe side component 301 of ride mode 300 can have a vertical movement restraint 319 that is positioned above the top surface of ski 102. Vertical movement restraint 319 can extend past inside edge 103A such that when ski 101 and ski 102 are joined as shown in FIG. 3G, vertical movement restraint 319 extends over ski 101 to prevent or limit upward movement of ski 101 relative to ski 102. Vertical movement restraint 319 can have surface 321 that extends in a generally radial shape from the top of toe side component 301 to the bottom of toe side component 301. The bottom of surface 321 is designed to be generally tangent to the inside edge 103A. The general radial shape of surface 321 and tangency to inside edge 103A limit and/or prevent snow and ice buildup between inside edge 103A and toe side component 301. Heel side component 302 has a mating surface 320. Surface 320 can match the same generally radial shape of surface 321. When ski 101 and ski 102 are joined as shown in FIG. 3G surface 321 and surface 320 can touch to prevent or limit upward movement of ski 101 relative to ski 102. Surface 321 can be replaced with a multitude of surface types such as a 45 degree surface or any other surface that prevents a sharp 90 degree angle between inside edge 103A and vertical movement restraint 319 where snow or ice can easily build up. Surface 321 can be designed to allow snow and or ice to be removed easily with a user's fingers, with or without gloves.

Figure 4A:
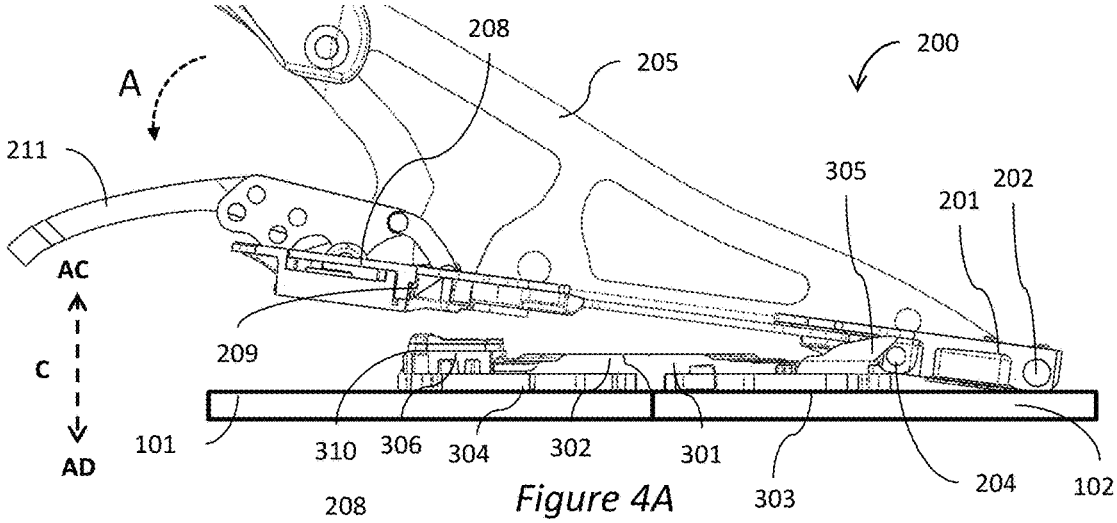
FIG. 4A is a side view of an example splitboard binding attaching to an example ride mode interface.
Figure 4B:
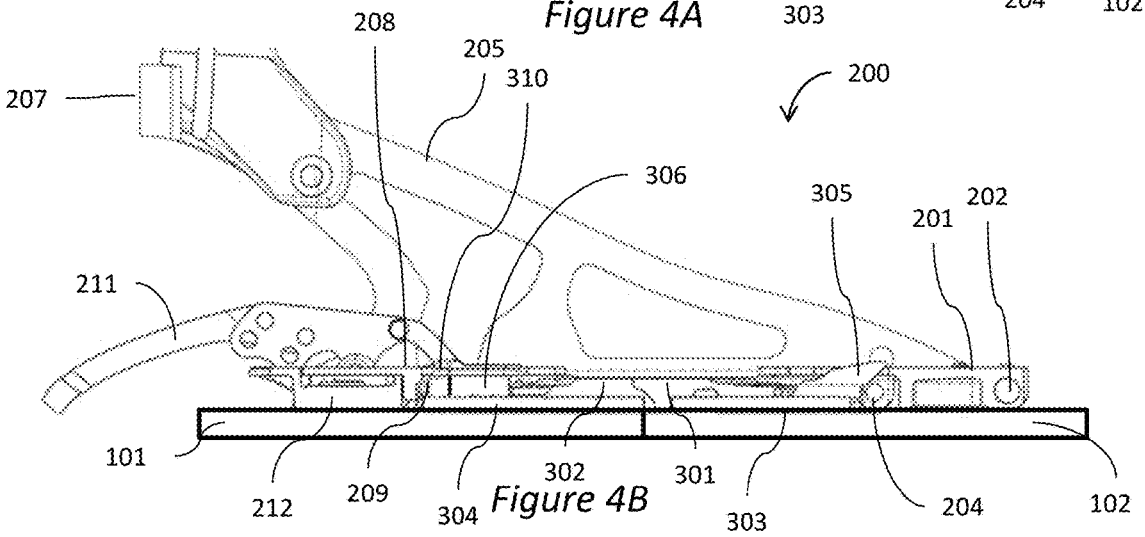
FIG. 4B is a side view of an example splitboard binding attaching to an example ride mode interface.
Figure 4C:
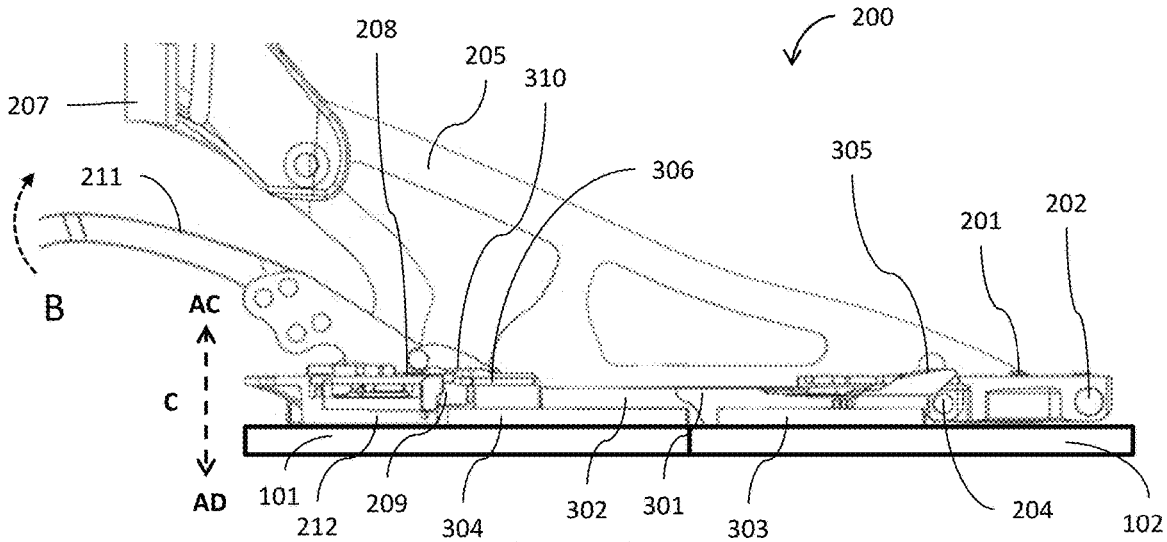
FIG. 4C is a side view of an example splitboard binding attaching to an example ride mode interface.

FIGS. 4A through 4C are a side section view of example binding interface 200 engaging ride mode interface 300. FIG. 4A shows example binding interface 200 slightly off the horizontal with catch pin 204 engaging catch 305 of ride mode interface 300. Catch 305 constrains the toe side portion of example binding interface 200 in a generally vertical direction along path C and in a toe to heel direction AE along path E (see FIG. 3D for path E). Example binding interface 200 with lever 211 in the open position and lock pin 209 retracted can rotate along path A for heel stay 208 to engage heel attachment 306, as shown in FIG. 4B. With lock pins 209 retracted, the heel side portion of example binding interface 200 is not constrained generally vertically along patch C in the AC direction and is not constrained generally horizontally along path D in the medial direction AA or the lateral direction AB (see FIGS. 3C and 3D for path D). Example binding interface 200 can drop on to ride mode interface 300 or be removed from ride mode interface 300 with little to no resistance because of the large clearances between heel attachment 306 and heel stay 208. In some embodiments, ideal horizontal clearance between heel attachment 306 and heel stay 208 is between about 1 mm and 4 mm.

FIG. 4C shows example binding interface 200 fixed to ride mode interface 300 with the lever closing along path B and the lock pins 209 engaging vertical constraint element 310. Lock pin 209 can have an interference fit with vertical constraint element 310 creating compression between heel stay pad 212 of heel stay 208 and ski 101 of splitboard 100. The compression between example binding interface 200 and splitboard 100 creates a responsive connection by removing clearance between example binding interface 200, ride mode interface 300 and splitboard 100. In a second example embodiment it is possible for the lock pin 209 to be a part of ride mode interface 300 and the heel attachment 306 to be a part of binding interface 200.

Figure 5A:
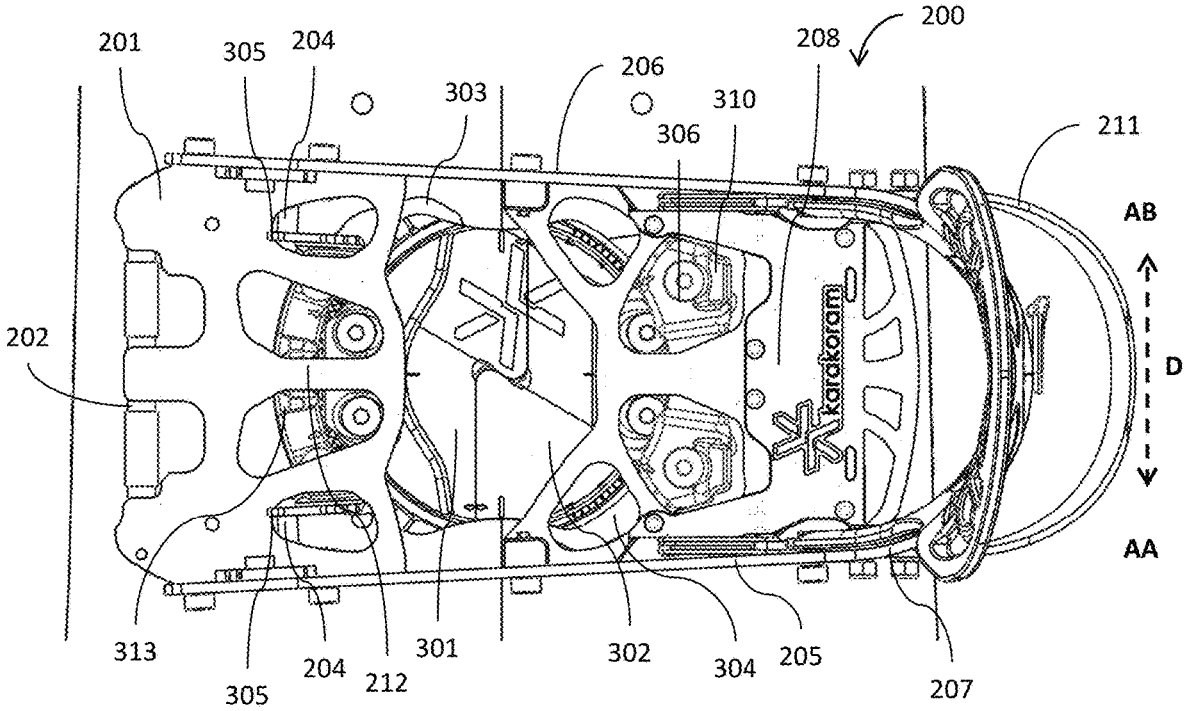
FIG. 5A is a top view of an example splitboard binding attaching to an example ride mode interface.
Figure 5B:
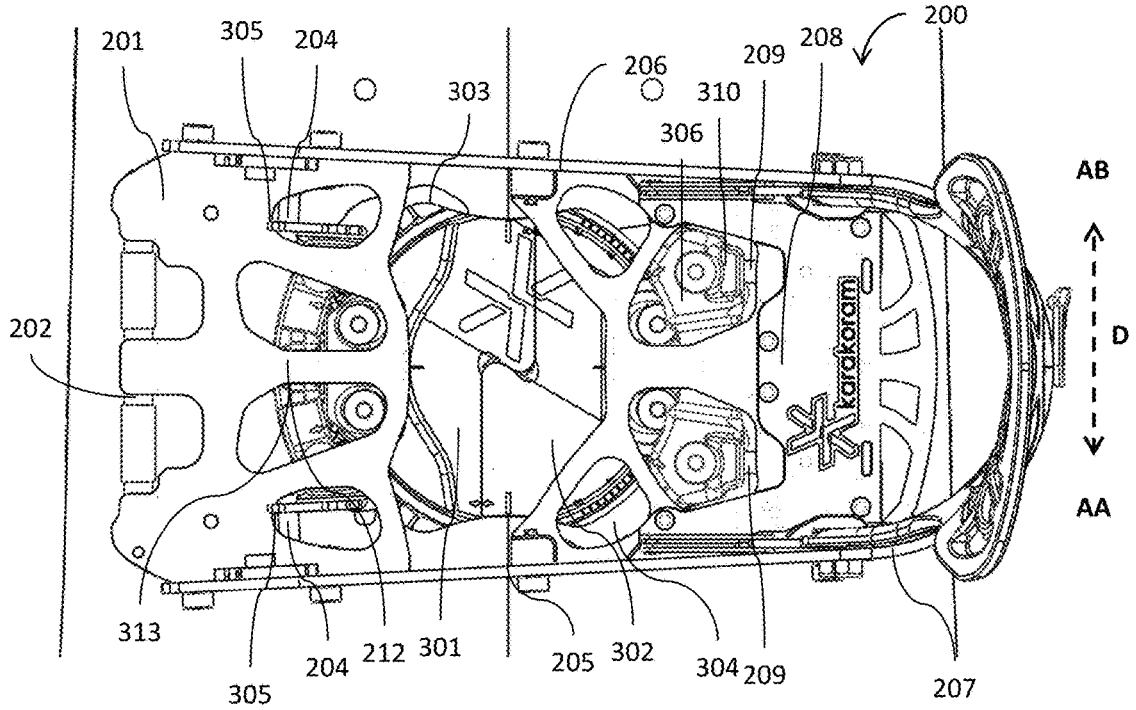
FIG. 5B is a top view of an example splitboard binding attaching to an example ride mode interface.

FIGS. 5A and 5B show a top view of example binding interface 200 engaged with ride mode interface 300. FIG. 5A shows lever 211 in the open position and lock pins 209 retracted into heel stay 208. FIG. 5B shows lever 211 in the locked position and the lock pins 209 extended out of heel stay 208 and engaging vertical constraint element 310 and horizontal constraint elements 311A and 311B.

Figure 5C:
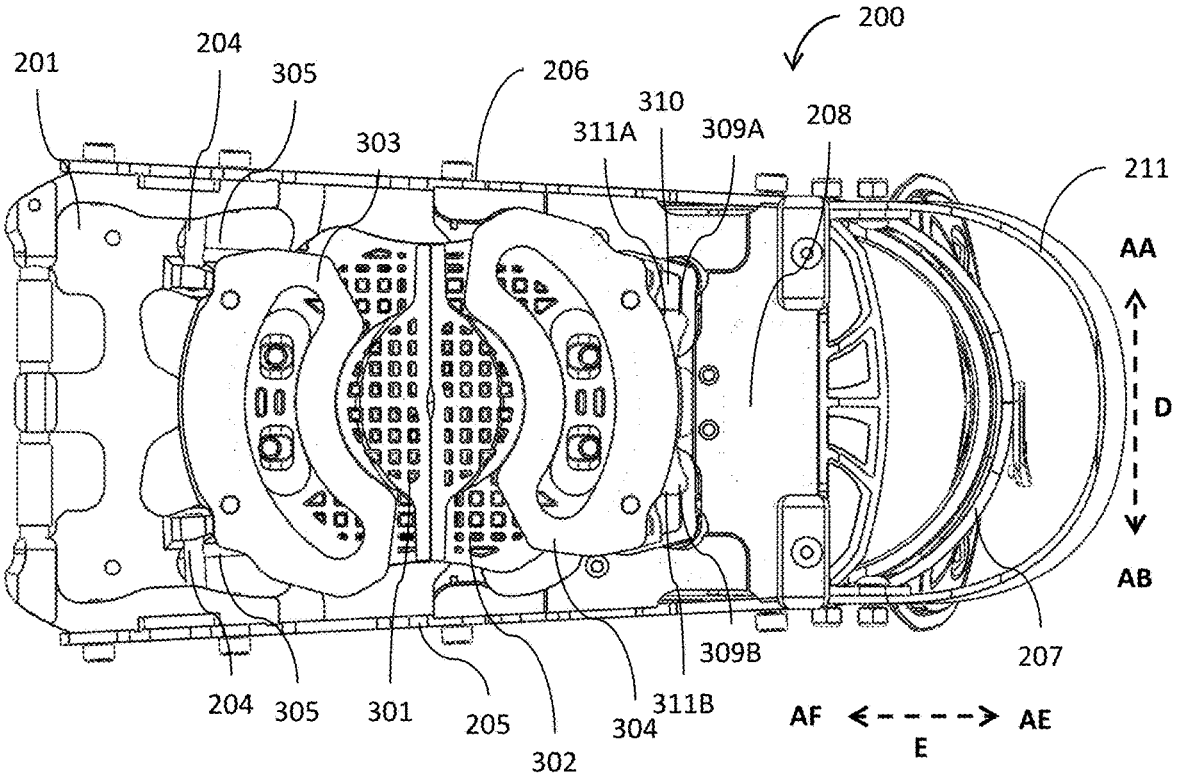
FIG. 5C is a bottom view of an example splitboard binding attaching to an example ride mode interface.
Figure 5D:
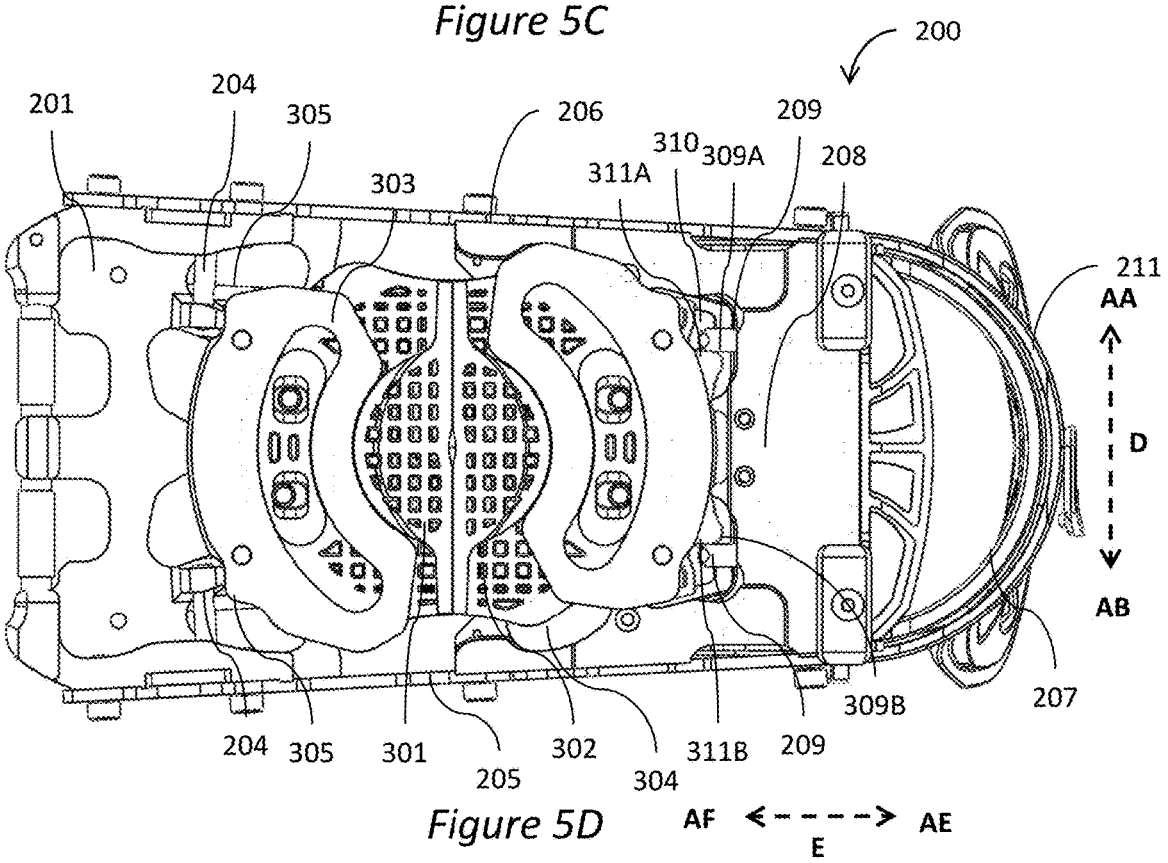
FIG. 5D is a bottom view of an example splitboard binding attaching to an example ride mode interface.

FIGS. 5C and 5D show a bottom view of example binding interface 200 engaged with ride mode interface 300. FIG. 5C shows lever 211 in the open position and lock pins 209 retracted into heel stay 208. FIG. 5D shows lever 211 in the locked position and the lock pins 209 extended out of heel stay 208 and engaging vertical constraint element 310 and horizontal constraint elements 311A and 311B.

Figure 6A:
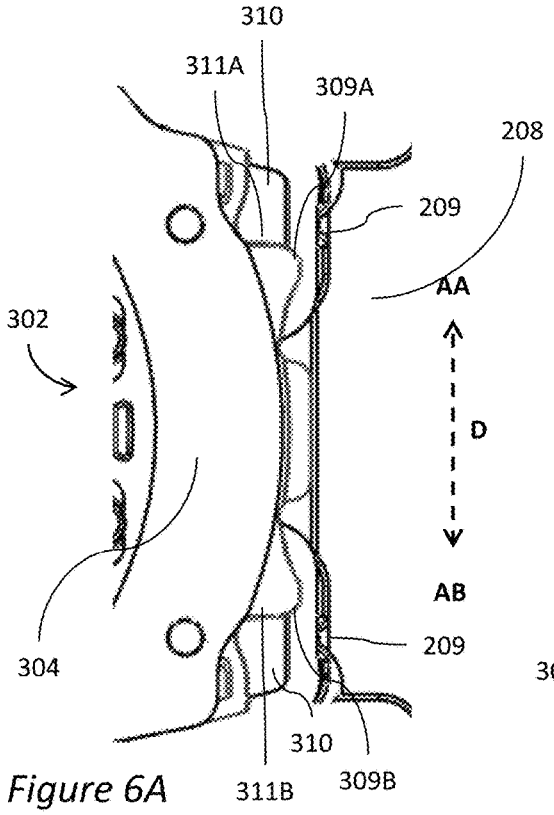
FIG. 6A is a detailed bottom view of an example splitboard binding attaching to an example ride mode interface.

FIGS. 6A through 6D show a bottom detailed view of the interactions between the lock pins 209 of example binding interface 200 and the heel attachment 306 of ride mode interface 300. FIG. 6A shows lock pins 209 fully retracted into heel stay 208. The heel side portion of example binding interface 200 is not constrained vertically along path C in the direction AC (see FIGS. 3C, 4A, 4C) and is not constrained horizontally along path D in the medial direction AA or lateral direction AB.

Figure 6B:
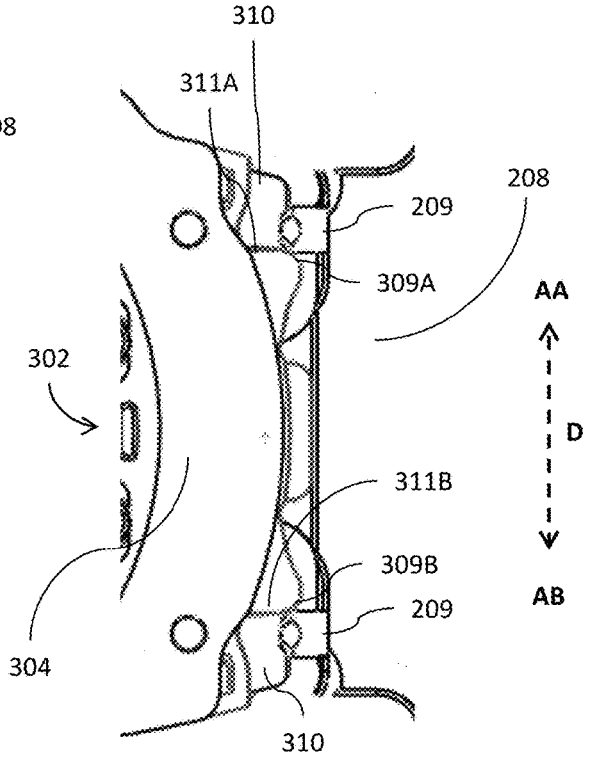
FIG. 6B is a detailed bottom view of an example splitboard binding attaching to an example ride mode interface.

FIG. 6B shows lock pins 209 extending from heel stay 208 and starting to engage horizontal guides 309A and 309B so that example binding interface 200 aligns properly along horizontal path D.

Figure 6C:
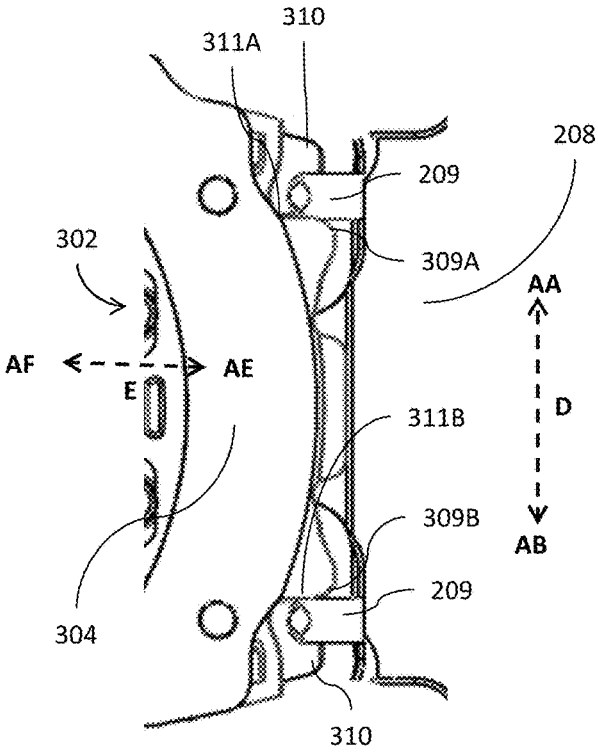
FIG. 6C is a detailed bottom view of an example splitboard binding attaching to an example ride mode interface.

FIG. 6C shows lock pins 209 further extending to engage horizontal constraint elements 311A and 311B. Horizontal constraint element 311A constrains example binding interface 200 generally horizontally along path D in the medial direction AB. Horizontal constraint element 311B constrains example binding interface 200 generally horizontally along path D in the lateral direction AA.

Figure 6D:
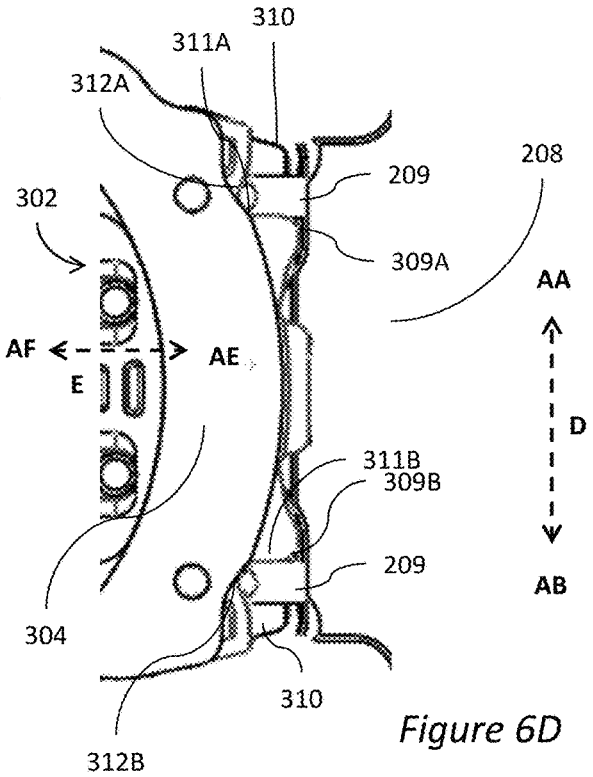
FIG. 6D is a detailed bottom view of an example splitboard binding attaching to an example ride mode interface.

FIG. 6D shows lock pins 209 in a configuration where the lock pins 209 can extend far enough to contact back stops 312A and 312B, constraining example binding interface 200 in a general heel to toe direction AF along path E.

Figure 7A:
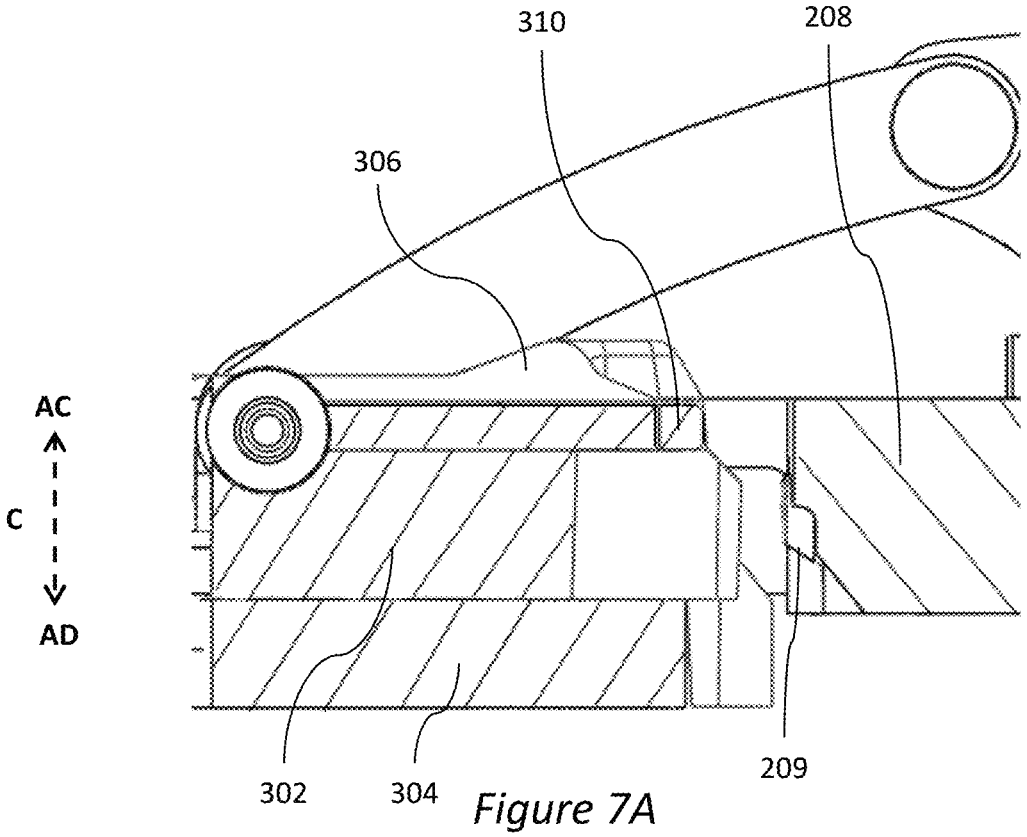
FIG. 7A is a detailed side view of an example splitboard binding attaching to an example ride mode interface.
Figure 7B:
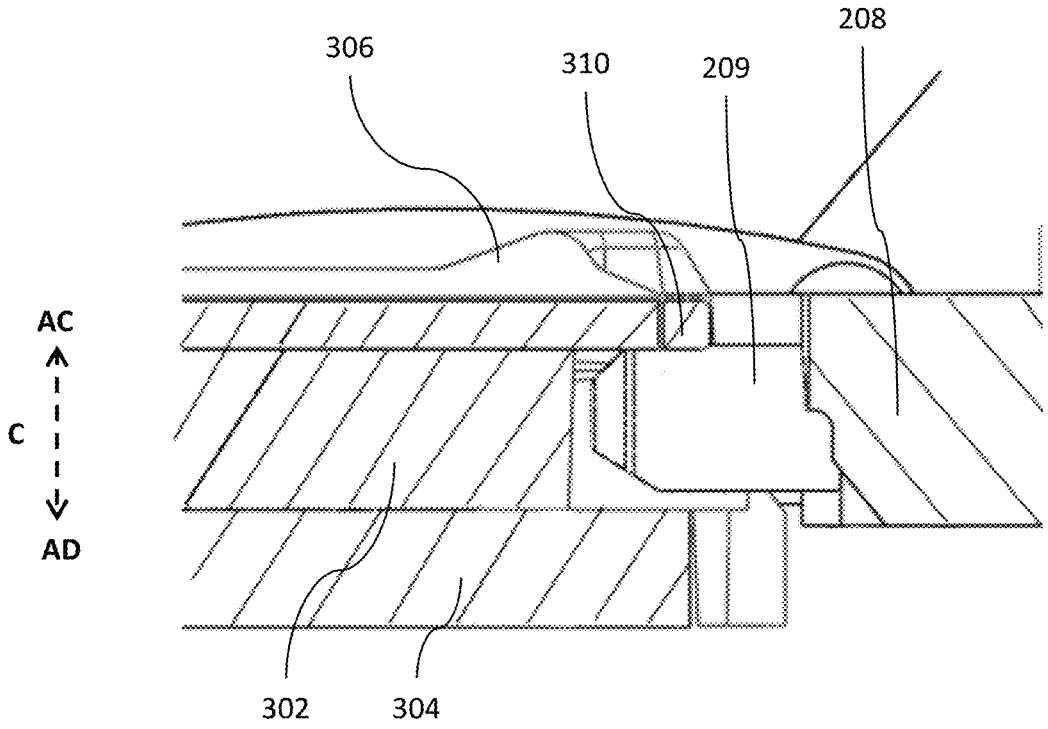
FIG. 7B is a detailed side view of an example splitboard binding attaching to an example ride mode interface.

FIGS. 7A and 7B are a detailed cross sectional view of interactions between lock pins 209 of example binding interface 200 and vertical constraint element 310 of ride mode interface 300. FIG. 7A show lock pins 209 retracted into heel stay 208 and not engaged with vertical constraint element 310. FIG. 7B shows lock pins 209 engaging vertical constraint element 310. Lock pins 209 can have an interference fit with vertical constraint element 310 creating compression between heel stay pad 212 of heel stay 208 and ski 101 of splitboard 100.

The splitboard binding and components thereof disclosed herein and described in more detail above may be manufactured using any of a variety of materials and combinations. In some embodiments, a manufacturer may use one or more metals, such as aluminum, stainless steel, steel, brass, alloys thereof, other suitable metals, and/or combinations thereof to manufacture one or more of the components of the splitboard binding of the present disclosure. In some embodiments, the manufacturer may use one or more plastics to manufacture one or more components of the splitboard binding of the present disclosure. In some embodiments, the manufacturer may use carbon-reinforced materials, such as carbon-reinforced plastics, to manufacture one or more components of the splitboard binding of the present disclosure. In some embodiments, the manufacturer may manufacture different components using different materials to achieve desired material characteristics for the different components and the splitboard binding as a whole.

Conditional language such as, among others, "can," "could," "might," or "may," unless specifically stated otherwise, are otherwise understood within the context as used in general to convey that certain embodiments include, while other embodiments do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

It should be emphasized that many variations and modifications may be made to the embodiments disclosed herein, the elements of which are to be understood as being among other acceptable examples. Accordingly, it should be understood that various features and aspects of the disclosed embodiments can be combined with or substituted for one another in order to form varying modes of the disclosed apparatus, systems, and methods. All such modifications and variations are intended to be included and fall within the scope of the embodiments disclosed herein. The present disclosure may be embodied in other specific forms without departing from its spirit or essential characteristics. The described embodiments are to be considered in all respects only as illustrative and not restrictive.

What is claimed is:

1. A splitboard binding comprising:

a first interface configured to receive a boot, the first interface comprising a first attachment portion and a second attachment portion, wherein the first attachment portion generally opposes the second attachment portion;

a second interface configured to attach to a splitboard, the second interface configured to couple to the first interface in a ride mode configuration wherein the second interface comprises a first receiving component and a second receiving component, the first receiving component configured to be attached to a first splitboard ski and the second receiving component configured to be attached to a second splitboard ski;

wherein the first attachment portion of the first interface is configured to engage the first receiving component of the second interface and the second attachment portion of the first interface is configured to engage the second receiving component of the second interface;

the second attachment portion of the first interface having a locking mechanism, the locking mechanism having an open position and locked position;

the first interface and the second interface having a first configuration where the first interface and second interface are disengaged;

the first interface and the second interface having a second configuration where the first interface and second interface are loosely engaged with a clearance fit in at least two directions and the locking mechanism of the first interface is in the open position; and the first interface and the second interface having a third configuration where the first interface and second interface are substantially fixed and join the splitboard skis, wherein in the third configuration the locking mechanism of the first interface is in the locked position, and wherein when the locking mechanism of the first interface is in the locked position and engaged with the second interface the locking mechanism constrains the first interface to the second interface in at least two directions and wherein the second interface compresses the first interface into the splitboard skis.

2. The splitboard binding of claim 1, the first interface further comprising a toe side, a heel side, a medial side and a lateral side, wherein in the third configuration the locking mechanism of the first interface is in the locked position and engaged with the second interface such that the locking mechanism constrains the first interface to the second interface vertically and in a direction generally perpendicular to the medial and lateral sides of the first interface.

3. The splitboard binding of claim 1, wherein the first attachment portion is generally on the toe side of the first interface and the second attachment portion is generally on the heel side of the first interface.

4. The splitboard binding of claim 1, wherein the first attachment portion is generally on the heel side of the first interface and the second attachment portion is generally on the toe side of the first interface.

5. The splitboard binding of claim 1, wherein the first attachment portion is on either the medial or lateral side of the first interface and the second attachment portion is on the opposing side.

6. The splitboard binding of claim 2, wherein the second receiving component of the second interface guides the first interface into position in the direction generally perpendicular to the medial and lateral sides of the first interface as the locking mechanism is being engaged.

7. The splitboard binding of claim 2, wherein the locking mechanism of the first interface further constrains the first interface to the second interface in a direction generally parallel to the medial side and lateral side of the first interface.

8. A splitboard binding comprising:

a first interface configured to receive a boot, the first interface comprising a toe side, a heel side, a medial side and a lateral side;

a second interface configured to attach to a splitboard, the second interface configured to couple to the first interface in a ride mode configuration, wherein the second interface comprises at least a first receiving component and at least a second receiving component, the first receiving component configured to be attached to a first splitboard ski and the second receiving component configured to be attached to a second splitboard ski;

the first interface having a locking mechanism, the locking mechanism having an open position and locked position;

the first interface and the second interface having a first configuration where the first interface and second interface are disengaged;

the first interface and the second interface having a second configuration where the first interface and second interface are loosely engaged with a loose clearance fit in a direction generally perpendicular to the medial and lateral sides of the first interface and at least the locking mechanism of the first interface is free from vertical constraint, and the locking mechanism of the first interface is in the open position; and the first interface and the second interface having a third configuration where the first interface and second interface are substantially fixed and join the splitboard skis to make a snowboard, wherein in the third configuration the locking mechanism of the first interface is in the locked position, and wherein when the locking mechanism of the first interface is in the locked position and engaged with the second interface the locking mechanism constrains the first interface to the second interface in a direction generally perpendicular to the medial and lateral sides of the first interface and vertically.

9. The splitboard binding of claim 8, wherein in the second configuration the first interface disengages from the second interface in a generally vertical direction and loosely engages the second interface in a generally vertical direction.

10. The splitboard binding of claim 8, wherein the first interface further comprises a first attachment portion and a second attachment portion, wherein the first attachment portion generally opposes the second attachment portion, and wherein the first attachment portion of the first interface is configured to engage the first receiving component of the second interface and the second attachment portion of the first interface is configured to engage the second receiving component of the second interface.

11. The splitboard binding of claim 8, wherein the locking mechanism is a pin.

12. The splitboard binding of claim 8, wherein the locking mechanism is driven by a lever.

13. A splitboard binding comprising:

a first interface configured to receive a boot, the first interface comprising a toe side, a heel side, a medial side and a lateral side;

a second interface configured to attach to a splitboard, the second interface configured to couple to the first interface in a ride mode configuration wherein the second interface comprises at least a first receiving component and at least a second receiving component, the first receiving component configured to be attached to a first splitboard ski and the second receiving component configured to be attached to a second splitboard ski;

the first interface having a locking mechanism, the locking mechanism having an open position and locked position;

the first interface and the second interface having a first configuration where the first interface and second interface are disengaged;

the first interface and the second interface having a second configuration where the first interface engages and disengages the second interface in a generally vertical direction;

the first interface and the second interface having a third configuration wherein the engagement of the locking mechanism of the first interface with the second interface constrains movement of the first interface relative to the second interface in a plane parallel to the top surface of the first splitboard ski and prevents disengagement of the first interface from the second interface in a generally vertical direction.

14. The splitboard binding of claim 13, wherein the locking mechanism constrains vertical movement between the first interface and the second interface.

15. The splitboard binding of claim 13, wherein in the third configuration the second interface guides the first interface into position in the direction generally perpendicular to the medial and lateral sides of the first interface as the locking mechanism is being engaged.

16. The splitboard binding of claim 13, wherein in the third configuration the locking mechanism prevents rotation of the first interface relative to the second interface in a plane parallel to the top surface of the first ski.

17. The splitboard binding of claim 13, wherein the first receiving component further comprises a top surface, a bottom surface, and a restraint surface that extends past the seam of the splitboard, wherein from the bottom surface the restraint surface extends generally tangentially from the seam of the splitboard and generally radially to the top surface of the receiving component.

18. The splitboard binding of claim 13, wherein the first receiving component further comprises a top surface, a bottom surface, and a restraint surface that extends past the seam of the splitboard, wherein from the bottom surface the restraint surface extends at an angle greater than 90 degrees from the seam of the splitboard and to the top surface of the receiving component.

* * * * *